US008234818B2

(12) United States Patent
Hecht et al.

(10) Patent No.: US 8,234,818 B2
(45) Date of Patent: Aug. 7, 2012

(54) REFRIGERATING AND/OR FREEZING APPLIANCE

(75) Inventors: Josef Hecht, Erlenmoos (DE); Dietmar Blersch, Ertingen (DE); Georg Dorner, Steinhausen/Rottum (DE)

(73) Assignee: Liebherr-Hausgerate Ochsenhausen GmbH, Ochsenhausen (DE)

( * ) Notice: Subject to any disclaimer, the term of this patent is extended or adjusted under 35 U.S.C. 154(b) by 574 days.

(21) Appl. No.: 11/989,147

(22) PCT Filed: Jul. 19, 2006

(86) PCT No.: PCT/EP2006/007123

§ 371 (c)(1),
(2), (4) Date: Sep. 10, 2009

(87) PCT Pub. No.: WO2007/009783

PCT Pub. Date: Jan. 25, 2007

(65) Prior Publication Data

US 2010/0018240 A1 Jan. 28, 2010

(30) Foreign Application Priority Data

Jul. 20, 2005 (DE) ..... 20 2005 011 427 U

(51) Int. Cl.
*E05F 11/00* (2006.01)

(52) U.S. Cl. ..... 49/358; 49/31

(58) Field of Classification Search ..... 49/334, 49/31, 386, 324, 339, 340, 345, 358, 359; 312/319.5, 326, 327, 405
See application file for complete search history.

(56) References Cited

U.S. PATENT DOCUMENTS

| | | | | | |
|---|---|---|---|---|---|
| 3,354,583 | A | * | 11/1967 | Moorman et al. | 49/276 |
| 3,988,860 | A | | 11/1976 | Nevarez | |
| 4,045,914 | A | | 9/1977 | Catlett | |
| 5,123,204 | A | | 6/1992 | He | |
| 5,278,480 | A | * | 1/1994 | Murray | 318/626 |
| 5,579,606 | A | * | 12/1996 | Kim | 49/386 |
| 5,878,530 | A | * | 3/1999 | Eccleston et al. | 49/139 |
| 5,988,709 | A | * | 11/1999 | Lee et al. | 292/199 |
| 6,061,964 | A | * | 5/2000 | Arnell et al. | 49/359 |
| 6,230,137 | B1 | * | 5/2001 | Has et al. | 704/275 |
| 6,270,175 | B1 | * | 8/2001 | Sfeir | 312/319.9 |
| 6,338,536 | B1 | * | 1/2002 | Ueno et al. | 312/405 |
| 6,811,236 | B1 | * | 11/2004 | Spong et al. | 312/405 |
| 2001/0007163 | A1 | * | 7/2001 | Alonso | 16/58 |
| 2004/0103584 | A1 | | 6/2004 | Freeman | |
| 2005/0262868 | A1 | * | 12/2005 | Jeong et al. | 62/408 |

FOREIGN PATENT DOCUMENTS

| | | |
|---|---|---|
| DE | 29621527 | 4/1998 |
| DE | 19901365 | 3/2000 |
| DE | 10230508 | 1/2004 |
| DE | 20308256 | 5/2004 |
| DE | 20301951 | 6/2004 |
| GB | 872577 | 7/1961 |
| GB | 893799 | 11/1962 |

* cited by examiner

*Primary Examiner* — Katherine W Mitchell
*Assistant Examiner* — Justin Rephann
(74) *Attorney, Agent, or Firm* — Dilworth & Barrese, LLP.

(57) ABSTRACT

A refrigerator and/or freezer with an appliance carcass, can be closed by at least one door, and a powered door operating device for automatically operating the door. The door operating device has drives both automatically opening and closing the door.

11 Claims, 2 Drawing Sheets

REFRIGERATING AND/OR FREEZING APPLIANCE

The present invention relates to a refrigerator and/or freezer with an appliance carcass, which can be closed by at least one door, and a powered door operating device for automatically operating the door.

BACKGROUND OF THE INVENTION

From DE 203 01 951 U1 a refrigerator and freezer is known, whose door is pushed open by a motor and a tappet driven by the same, in order to facilitate opening the door and in particular overcome the door seal holding and vacuum forces usually present in refrigerators and freezers. The tappet is driven by the motor via an eccentric and gets out of engagement after initially pushing open, so that the door can manually be opened further and be closed again, wherein upon opening the tappet is returned to its retracted. position by the motor, so that the door can be closed. Even if such door opening aid considerably facilitates opening the door of the refrigerator and freezer, a further simplification of the handling of the door nevertheless is desirable. Initially pushing open the door is not sufficiently helpful when, for instance, refrigerated goods must be carried with both hands and no hand is free for door operation. It would also be desirable that the door is not able to move on its own after being pushed open initially, for instance due to a skew orientation of the appliance and the force of gravity acting on the door.

SUMMARY OF THE INVENTION

Proceeding therefrom, it is the object of the present invention to create an improved refrigerator and/or freezer, which eliminates the disadvantages of the prior art and develops the latter in an advantageous way. Preferably, door operation should further be simplified and be rendered even more comfortable.

In accordance with the invention, this object is solved by a refrigerator and/or freezer with the features herein. Preferred aspects of the invention are also subject-matter herein.

Thus, the door operating device of the invention is not restricted to pushing the door open, in order to overcome the door seal holding and vacuum forces. In accordance with the invention, the door operating device has drive means both for automatically opening and for automatically closing the door. Operating comfort thereby is increased considerably, in particular when upon removal of refrigerated or frozen goods no hand is free for manually closing the door.

Advantageously, the drive means can be formed such that the door substantially is automatically movable by the drive means over its entire intended range of movement. For this purpose, the drive means not only are in operative connection with the door in a very small angular range about the closed position. Advantageously, an actuating force can be applied onto the door by the drive means over a swivel range of at least 75°, advantageously over more than 90°, so that the door can completely be opened, be decelerated towards the open position and be maintained in this position by the drive means. Upon filling the refrigerating or freezing space or upon removal of refrigerated or frozen goods, the door can then be closed again automatically by the drive means.

In accordance with a development of the invention, the drive means are formed such that the door can approach a predeterminable open position, which advantageously can be adjustable. In particular, a control means can be connected with the drive means, which allows to fix the open position for instance at 90° or, when the refrigerator is installed in a corner, at 80°.

In contrast to mere push-open aids, the drive means of the door operating device advantageously can provide different door velocities, in particular such that the door moves through a predefined velocity profile on its opening path and/or on its closing path. The drive means can be actuated by the preferably electronic control means such that the door is smoothly accelerated from the closed and/or open position, is moved relatively fast in a middle range of movement between the open position and the closed position, and then is smoothly decelerated before reaching the open and/or closed position, so that it smoothly approaches the holding position. In accordance with a development of the invention, the door operating device thus substantially controls the door velocity in the desired way over its entire range of movement.

To prevent a forced movement of the door when hitting obstacles or to prevent pinching of body parts when closing the door, a force limiter for limiting the actuating force when opening and/or closing the door and/or when holding the door in a desired position can be associated to the drive means in accordance with a particularly advantageous development of the invention. By means of this safety solution it is achieved that the door ceases to swivel when hitting an obstacle. By limiting the force it can also be ensured that the door can in any case be opened again with a child's force, i.e. in particular also when it is held in the closed position, for instance when a child is locked in the refrigerating or freezing space.

In principle, different types of force limiter can exist. For instance, a sensor-controlled solution can be provided, which upon detection of a predetermined force externally acting on the door disengages the drive means via suitable coupling means, so that the door can be operated free-wheeling, so to speak. In an advantageous development of the invention, however, the force limiter is realized by a sliding clutch which is connected with the door drive motor of the door operating device. The driving and/or holding force of the motor itself need not be limited thereby. When a predetermined actuating force is exceeded, the sliding clutch allows to move the door independent of a movement of the door drive motor.

To ensure, on the other hand, that the partly high door seal holding and vacuum forces are overcome when opening the door and the door can safely be opened, a shunt is provided in accordance with a development of the invention for bridging the aforementioned force limiter, which shunt advantageously only is effective in the closed position of the door and/or in an adjoining limited range of movement. In principle, different types of shunt can exist. It can be realized for instance by a second drive train, which actuates the door parallel to the drive train connected with the sliding clutch. In principle, it would of course also be conceivable to provide a second, separate drive motor and a corresponding actuator for pushing the door open from the closed position. By means of the aforementioned shunt, however, it can be ensured despite the use of a sliding clutch that the full driving force can be utilized when pushing open the door.

In principle, the drive means for closing and opening the door can comprise a drive unit for opening and a further drive unit for closing the door. In accordance with a preferred embodiment of the invention, however, the drive means have a common motor, in particular an electric motor, for generating the opening and closing actuating forces. On the one hand, the common motor can directly produce both the opening movement and the closing movement. On the other hand, it can also be provided that only the opening movement of the door is derived directly from the motor, whereas the closing movement is produced by a spring mechanism, which in particular during the opening movement is tensioned by said common motor.

Advantageously, at least one transmission is provided between the appliance carcass and the door for transmitting the drive movement of the motor to the door. In accordance with one embodiment of the invention, the motor can act on the door via a gear transmission, which preferably can be disposed in the vicinity of the door swivel axis.

Alternatively or in addition, there can also be provided a cable-, belt- and/or chain-type transmission for transmitting the drive movement of the motor to the door.

Furthermore alternatively or in addition, the drive means can include a spring means pretensionable by a motor for generating the actuating force in one direction of movement, wherein a damper advantageously can be associated to the spring means, which attenuates the door movement generated by the spring force at least before reaching the end position of the door.

The control of the drive means of the door operating device can be effected in various ways. To achieve a simple operation, a triggering sensor for starting the door movement can be associated to the drive means. The triggering sensor can realize various operating principles. In a simple embodiment of the invention, the triggering sensor can be a mechanical switch, which can be actuated by a hand or a finger. When the switch is depressed, the drive means start to move.

Alternatively or in addition to such mechanical switch, there can also be provided an acoustic sensor for starting the drive means, in order to be able to start the door operation by voice control.

Alternatively or in addition, there can also be used an optical sensor, which for instance in the manner of a motion sensor detects a body part passing by a predetermined region before the appliance.

Alternatively or in addition, a force sensor can also be provided for starting the drive means, which detects a door operating force externally acting on the door. The door operating device thereby can be activated for instance by slightly pushing the door or by slightly pulling the door handle.

In accordance with a development of the invention, an automatic shut-off of the drive means is provided in the two end positions of the door. If the door operating device is started in the manner described above, it will automatically approach the end position, i.e. the open position when opening the door and the closed position when closing the door. When reaching this end position, the drive means are shut off automatically.

BRIEF DESCRIPTION OF THE DRAWINGS

The invention will be explained below in detail with reference to an embodiment and associated drawings, in which.

BRIEF DESCRIPTION OF THE PREFERRED EMBODIMENTS

Figure 1:
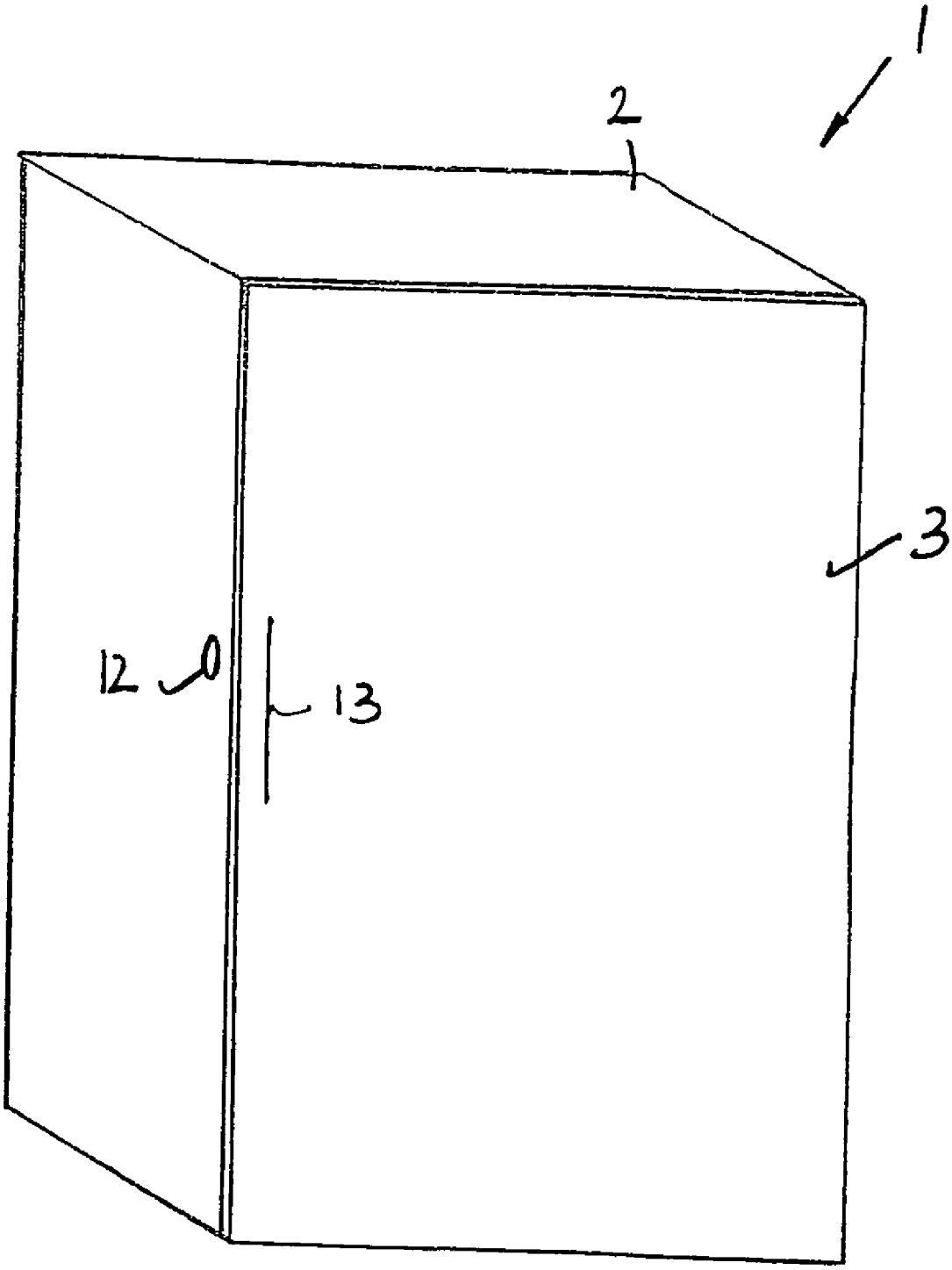
FIG. 1: shows a perspective view of a refrigerator and freezer according to a preferred embodiment of the invention.

The refrigerator and freezer 1 shown in FIG. 1 comprises a substantially cubic appliance carcass 2 which can be closed by a door 3, which in a manner known per se is pivotally mounted on the appliance carcass 2 about an upright door swivel axis 4.

Figure 2:
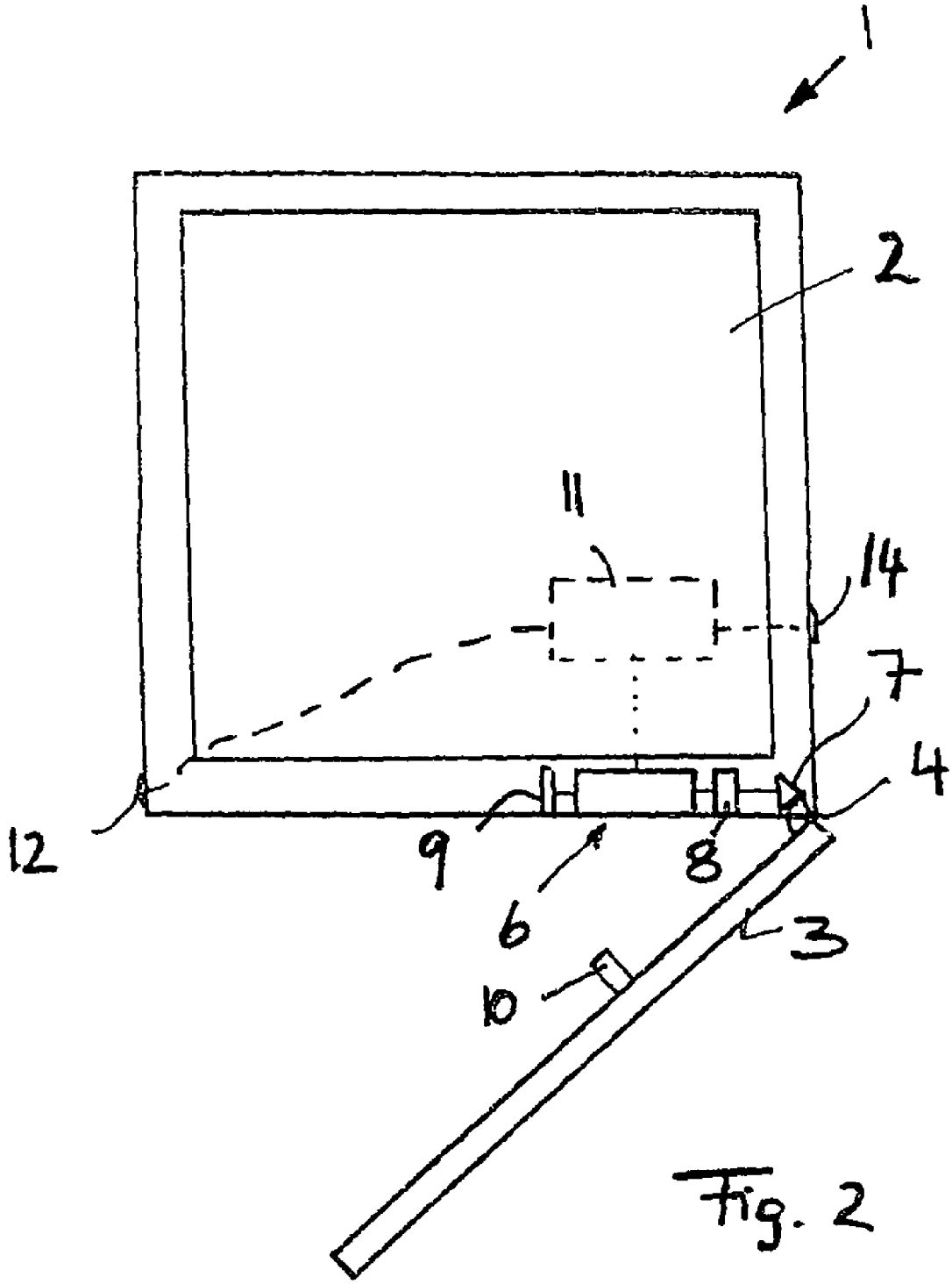
FIG. 2: shows a schematic representation of the door operating device with an electric motor for automatically opening and closing the door of the appliance shown in FIG. 1.

According to the embodiment shown in FIG. 2, a door operating device comprises an electric motor 6, which in the illustrated embodiment is mounted on the appliance carcass 2 and can swivel the door 3 open and closed via a gear transmission 7. In the illustrated embodiment, the gear transmission 7 is a bevel gear transmission and disposed in the vicinity of the door swivel axis 4, so that a large swivel range can be realized with a small size.

As shown in FIG. 2, a sliding clutch 8 is incorporated in the drive train from the electric motor 6 to the gear transmission 7, which ensures that the door stops when striking an obstacle although the motor runs on, or inversely that the door can be opened for instance by a child locked in the refrigerating space with the electric motor 6 standing still.

To be able to safely overcome the door seal holding and vacuum forces of the door despite the sliding clutch 8, a second drive train extends from the electric motor 6, which can have various designs and in the illustrated embodiment can comprise a gear wheel 9 driven by the electric motor 6 and a rack 10 provided on the door 3, which is dimensioned such that said second drive train only is effective in the closed position of the door 3 or in an adjoining small angular range. To ensure that the door also opens with the electric motor 6 standing still, the gear wheel 9 can be connected with the electric motor 6 via a freewheeling clutch.

As shown in FIG. 2, the electric motor 6 can be driven by an electronic control means 11, which is connected with a sensor 12 which detects that the user of the refrigerator wants an operation and in the illustrated embodiment is disposed on the appliance carcass 2 approximately at the level of the door handle 13 (cf. FIG. 1). Furthermore, the control means 11 can be connected with a control terminal 14, so as to be able to adapt the opening or closing movement of the door according to the wishes of the user or the conditions of the open position.

In particular the open position of the door 3, in which the electric motor 6 stops, can be programmed thereby.

In the embodiment of the door operating device illustrated in the Figures, the following function is obtained: When the door is closed, as shown in FIG. 1, the user must merely act on the sensor 12, for instance depress the same when it constitutes a mechanical switch. The control means 11 thereby starts the electric motor 6. Via the driving gear wheel 9 and the rack 10, the electric motor 6 pushes the door 3 open despite possibly existing large door seal holding and vacuum forces, even if the actuating forces via the first drive train with the gear transmission 7 are not sufficient due to the sliding clutch 8 provided therein. Upon initially pushing open, the driving gear wheel 9 is disengaged from the rack 10. Since the initial door seal holding and vacuum forces are overcome, however, the door is safely operated by the gear transmission 7, until it has reached its intended open position at, for instance, 90° . The control means 11 automatically stops the electric motor 6, the driving speed being reduced continuously and smoothly before reaching the open position, in order to achieve that the end position is approached smoothly.

For closing the door again, a timing circuit can be provided, which after a predetermined period again starts the drive motor in the opposite direction. Preferably, however, the closing movement can again be started by actuating the sensor 12. The electric motor 6 initially swivels the door 3 closed via the gear transmission 7. In the final phase of the closing movement, the rack 10 again gets in engagement with the driving gear wheel 9.

The door operating device advantageously constitutes an integral module which combines a multitude of advantages. First of all, the door 3 can automatically be opened in an extremely comfortable way, the door seal holding and vacuum forces being safely overcome. At the same time, a safety solution is realized to the effect that when striking an obstacle, the door ceases to swivel and the closed door can also be opened by a child's force, for instance by a child locked in the refrigerator. The door 3 can approach a predetermined open position and be maintained in said position. For instance, the door can be opened to 80° , to prevent the door from striking the wall when the appliance is installed in a corner. Advantageously, this open position can be varied via the control terminal 14. Furthermore, it is possible to stop the door 3 in various desired intermediate positions, which might be realized for instance by a further actuation of the sensor 12. Advantageously, the door always is guided, so that it cannot move on its own due to the orientation of the appliance and the force of gravity acting on the door. Particularly advantageously, the door is safely closed again without a gap being left open. Activating the door operating device for the opening and closing process can be effected via a manual operation, a foot operation or by voice control. Capacitive or inductive sensors, sensors based on the infrared principle or differently designed sensors can also be used for controlling the activation. In addition, a smooth closing or approach of the respective stop position is realized.

The invention claimed is:

1. An appliance containing at least one of a refrigerator or freezer and comprising an appliance body (2), at least one door (3) pivotally mounted on a swivel axis (4) on the appliance body (2), and a powered door operating device coupled to the door (3) for automatically operating the door (3), wherein the door operating device has an electric motor (6), first and second drive trains extending from opposite ends of the electric motor (6), a first gear transmission (7) coupled to the first drive train and the swivel axis (4) to swivel the door (3) open and closed, a sliding clutch (8) incorporated in the first drive train from the electric motor (6) to the first gear transmission (7) and arranged to stop the door (3) when striking an obstacle with the electric motor (6) running or allow the door (3) to be opened from within the appliance body (2) when the electric motor (6) is off, a gear wheel (9) mounted on the second drive train extending from the opposite end of the electric motor (6), and a rack (10) mounted on an inner side of the door (3) and arranged to interact with the gear wheel (9) to open the door (3) only when the door (3) is in closed or slightly open position.

2. The appliance according to claim 1, wherein the motor (6) is coupled to the door (3) to apply an actuating force onto the door (3) over its entire range of movement.

3. The appliance according to claim 1, wherein the sliding clutch (8) additionally limits actuating force when opening and/or closing and/or holding the door (3).

4. The appliance according to claim 1, wherein the door operating device controls the door (3) to approach a predeterminable open position.

5. The appliance according to claim 1, wherein control means (11) are connected with the motor (6) for adjusting and predetermining the open position of the door (3).

6. The appliance according to claim 5, wherein the control means (11) are additionally coupled to a sensor (12) arranged on the appliance body (2) for actuating operation of the door (3) by a user and a control terminal (14) arranged for adjusting opening or closing movement and the open position of the door (3).

7. The appliance according to claim 1, wherein the motor (6) is coupled to the door (3) such that the speed of movement of the door (3) changes along its opening and/or closing path, and the open and/or closed position can be approached with a reduced speed.

8. The appliance according to claim 1, additionally comprising a triggering sensor (12) coupled to the motor (6) for starting the same.

9. The appliance according to claim 8, wherein the triggering sensor (12) is a mechanical switch, an acoustic sensor, an optical sensor, a capacitive sensor, an inductive sensor, an infrared sensor or a force sensor.

10. The appliance according to claim 1, wherein a shut-off unit is coupled to the motor (6) for automatically shutting off the motor (6) upon reaching the closed and/or open position of the door (3).

11. The appliance according to according to claim 1, wherein the first gear transmission (7) is a bevel gear transmission.

* * * * *